US008960528B2

(12) United States Patent
Sadlier

(10) Patent No.: US 8,960,528 B2
(45) Date of Patent: Feb. 24, 2015

(54) INSULATING CUP WRAPPER AND INSULATED CONTAINER FORMED WITH WRAPPER

(75) Inventor: Claus E. Sadlier, Pleasanton, CA (US)

(73) Assignee: Dixie Consumer Products LLC, Atlanta, GA (US)

( * ) Notice: Subject to any disclaimer, the term of this patent is extended or adjusted under 35 U.S.C. 154(b) by 2412 days.

(21) Appl. No.: 11/182,330

(22) Filed: Jul. 14, 2005

(65) Prior Publication Data

US 2006/0144915 A1 Jul. 6, 2006

Related U.S. Application Data

(63) Continuation-in-part of application No. 11/098,853, filed on Apr. 4, 2005, now abandoned, which is a continuation-in-part of application No. 10/831,411, filed on Apr. 22, 2004, now abandoned.

(51) Int. Cl.
*B65D 3/22* (2006.01)
*B65D 81/38* (2006.01)

(52) U.S. Cl.
CPC ..... *B65D 3/22* (2013.01); *B65D 81/3874* (2013.01); *Y10S 229/939* (2013.01)
USPC ..... 229/403; 229/939

(58) Field of Classification Search
USPC ..... 229/403, 939; 220/737, 738, 739
See application file for complete search history.

(56) References Cited

U.S. PATENT DOCUMENTS 139,688 A 6/1873 Norton
154,498 A 8/1874 Long (Continued)

FOREIGN PATENT DOCUMENTS

CA 667719 1/1964
CH 0568053 A 10/1975

(Continued)

OTHER PUBLICATIONS

Walter Soroka, Fundamentals of Packaging, 1995, pp. 296-301: Publisher: Richard Warrington, USA.

(Continued)

*Primary Examiner* — Gary Elkins
(74) *Attorney, Agent, or Firm* — William W. Letson

(57) ABSTRACT

A thermally insulated cup is formed from a single-walled paper or plastic inner cup and an insulating outer wrapper. The insulating outer wrapper comprises a paper base sheet or outer sidewall blank, optionally printed on one side, and a corrugated paper or foamed plastic insulating insert. The insulating insert is similar in shape to the outer sidewall blank but smaller in size. The insert is glued in a centered position to the non-printed side of the sidewall blank to form a two-layered insulating wrapper. Less than 20% of the area of the insert is glued to the base sheet. Specifically, no glue is applied to the area adjacent to the cut side edges of the insert, and as such these edges are not attached to the base sheet. The wrapper is then wrapped around the single walled inner cup. The side edges of the base sheet of the wrapper overlap and are sealed directly together to form a side seam. The side seam is itself adhesively secured to the side wall of the inner cup. The side edges of the insert do not come between the seal between the side seam of the base sheet and the inner cup. The wrapper can also be adhered to the inner cup by one or more beads of cold glue (paste adhesive) or a thin layer of polyethylene (or similar heat sealing material) can be pre-applied to the inside cut edges of the base sheet. This is then heat-activated immediately prior to wrapping the wrapper around the inner cup, and pressing the overlapping side seam to the sidewall of the inner cup to simultaneously glue the side seam together, and to glue the insulating wrapper to the side wall of the cup.

25 Claims, 5 Drawing Sheets

(56) References Cited

U.S. PATENT DOCUMENTS

| | | | |
|---|---|---|---|
| 411,096 | A | 9/1889 | Eaton et al. |
| 472,463 | A | 4/1892 | Mark |
| 495,422 | A | 4/1893 | Meech |
| 502,951 | A | 8/1893 | Clark |
| 536,545 | A | 5/1895 | Schmidt |
| 546,179 | A | 9/1895 | McEwan |
| 563,962 | A | 7/1896 | Hinde |
| 858,385 | A | 7/1907 | Haefely |
| 901,334 | A | 10/1908 | Flipse |
| 950,785 | A | 3/1910 | Pene |
| 1,025,659 | A | 5/1912 | Vargyas et al. |
| 1,032,557 | A | 7/1912 | Luellen |
| 1,032,789 | A | 7/1912 | Swift, Jr. |
| 1,039,723 | A | 10/1912 | Gage |
| 1,067,237 | A | 7/1913 | Brandt |
| 1,091,526 | A | 3/1914 | Moore |
| 1,098,178 | A | 5/1914 | Semple |
| 1,100,809 | A | 6/1914 | Wilson |
| 1,106,005 | A | 8/1914 | Shevlin |
| 1,158,581 | A | 11/1915 | Swift, Jr. |
| 1,167,861 | A | 1/1916 | Vincent |
| 1,189,140 | A | 6/1916 | Lane |
| 1,208,483 | A | 12/1916 | Chesbrough |
| 1,216,617 | A | 2/1917 | Shevlin |
| 1,229,751 | A | 6/1917 | House |
| 1,243,658 | A | 10/1917 | Ford |
| 1,284,728 | A | 11/1918 | Luellen |
| 1,294,210 | A | 2/1919 | Wallertz |
| 1,295,418 | A | 2/1919 | Bohlman |
| 1,297,152 | A | 3/1919 | Hackney |
| 1,308,793 | A | 7/1919 | Luellen |
| 1,334,302 | A | 3/1920 | Hicks |
| 1,444,397 | A | 2/1923 | Seigle |
| 1,588,123 | A | 6/1926 | Maston |
| 1,692,951 | A | 7/1926 | Pickney |
| 1,615,254 | A | 1/1927 | Barker |
| 1,654,982 | A | 1/1928 | Luellen |
| 1,665,033 | A | 4/1928 | Jensen |
| 1,732,322 | A | 10/1929 | Wilson et al. |
| 1,771,765 | A | 7/1930 | Benson |
| 1,845,891 | A | 2/1932 | Schroeder |
| 1,850,013 | A | 3/1932 | Hinkley |
| 1,940,406 | A | 6/1932 | Ericson |
| 1,919,569 | A | 7/1933 | Oliver |
| 1,924,873 | A | 8/1933 | Moone |
| 1,955,745 | A | 4/1934 | Hurley |
| 1,962,199 | A | 6/1934 | Koch et al. |
| 2,017,810 | A | 10/1935 | Bodar et al. |
| 2,037,675 | A | 4/1936 | Boothby et al. |
| RE20,034 | E | 7/1936 | Ives |
| 2,051,076 | A | 8/1936 | Deakin |
| 2,055,877 | A | 9/1936 | Palmer |
| 2,075,465 | A | 3/1937 | Powell |
| 2,084,922 | A | 6/1937 | Sidebotham |
| 2,103,831 | A | 12/1937 | Sidon |
| 2,155,487 | A | 4/1939 | Hatch |
| 2,237,809 | A | 4/1941 | Bronson |
| 2,246,426 | A | 6/1941 | Wickstrom |
| 2,253,718 | A | 8/1941 | McKeage |
| 2,266,828 | A | 12/1941 | Sykes |
| 2,354,098 | A | 7/1942 | Bamber |
| 2,300,473 | A | 11/1942 | Van Winkle |
| 2,336,158 | A | 12/1943 | Bell |
| 2,347,236 | A | 4/1944 | Barbieri |
| 2,349,730 | A | 5/1944 | Horning |
| 2,389,547 | A | 11/1945 | Ringler |
| 2,416,813 | A | 3/1947 | Barbieri |
| 2,437,114 | A | 3/1948 | Moore |
| 2,444,861 | A | 7/1948 | Symmes |
| 2,453,159 | A | 11/1948 | Richter |
| 2,457,198 | A | 12/1948 | Bell |
| 2,501,815 | A | 3/1950 | Hamm |
| 2,503,874 | A | 4/1950 | Ives |
| 2,512,602 | A | 6/1950 | Bell |
| 2,563,352 | A | 8/1951 | Morse |
| 2,589,645 | A | 3/1952 | Tiegel |
| 2,591,578 | A | 4/1952 | McNealy et al. |
| 2,617,549 | A | 11/1952 | Egger |
| 2,623,680 | A | 12/1952 | Wilcox |
| 2,623,681 | A | 12/1952 | Wilcox |
| 2,641,402 | A | 6/1953 | Brunn |
| 2,642,372 | A | 6/1953 | Chittick |
| 2,841,402 | A | 6/1953 | Bruun |
| 2,653,887 | A | 9/1953 | Slayter |
| 2,661,889 | A | 12/1953 | Phinney |
| 2,686,555 | A | 8/1954 | Howard |
| 2,695,744 | A | 11/1954 | Gattuso |
| 2,719,662 | A | 10/1955 | Minteer et al. |
| 2,727,674 | A | 12/1955 | Rous |
| 2,755,983 | A | 7/1956 | Ringler |
| 2,758,047 | A | 8/1956 | Dowd |
| 2,775,384 | A | 12/1956 | Bergstrom |
| 2,805,808 | A | 9/1957 | Brewer |
| 2,828,903 | A | 4/1958 | Adkins |
| 2,830,005 | A | 4/1958 | Jackson |
| 2,842,301 | A | 7/1958 | Albert |
| 2,853,222 | A | 9/1958 | Gallagher |
| 2,917,215 | A | 12/1959 | Psaty et al. |
| 2,954,913 | A | 10/1960 | Rossman |
| 2,969,901 | A | 1/1961 | Behrens |
| 2,989,218 | A | 6/1961 | Bergstrom |
| 3,001,683 | A | 9/1961 | Goodwin |
| 3,049,277 | A | 8/1962 | Shappell |
| 3,079,027 | A | 2/1963 | Edwards |
| 3,082,900 | A | 3/1963 | Goodman |
| 3,083,891 | A | 4/1963 | Forrer |
| 3,089,630 | A | 5/1963 | Garvin |
| 3,106,237 | A | 10/1963 | Karl |
| 3,106,327 | A | 10/1963 | Karl |
| 3,123,273 | A | 3/1964 | Miller |
| 3,126,139 | A | 3/1964 | Schechter |
| 3,141,913 | A | 7/1964 | Edwards |
| 3,145,131 | A | 8/1964 | Finke |
| 3,156,401 | A | 11/1964 | Krause |
| 3,157,336 | A | 11/1964 | Elam |
| 3,157,337 | A | 11/1964 | Elam |
| 3,162,347 | A | 12/1964 | Taylor |
| 3,178,088 | A | 4/1965 | Herr |
| 3,182,794 | A | 5/1965 | Moore |
| 3,194,468 | A | 7/1965 | Baron |
| 3,203,611 | A | 8/1965 | Anderson et al. |
| 3,237,834 | A | 3/1966 | Davis et al. |
| 3,242,829 | A | 3/1966 | White |
| 3,254,827 | A | 6/1966 | Chapman |
| 3,279,675 | A | 10/1966 | Elam et al. |
| 3,317,110 | A | 5/1967 | Palmer |
| 3,372,830 | A | 3/1968 | Edwards |
| 3,383,025 | A | 5/1968 | Ferrey et al. |
| 3,385,502 | A | 5/1968 | Pilger |
| 3,394,800 | A | 7/1968 | Brackett et al. |
| 3,400,029 | A | 9/1968 | Mesrobian et al. |
| 3,410,473 | A | 11/1968 | Petrie |
| 3,414,184 | A | 12/1968 | Loheed |
| 3,428,239 | A | 2/1969 | Wannamaker et al. |
| 3,443,681 | A | 5/1969 | Wysocki |
| 3,443,714 | A | 5/1969 | Edwards |
| 3,443,715 | A | 5/1969 | Edwards |
| 3,456,860 | A | 7/1969 | Janninck |
| 3,456,863 | A | 7/1969 | Mollison et al. |
| 3,503,310 | A | 3/1970 | Goetz |
| 3,520,463 | A | 7/1970 | Ahlemeyer |
| 3,580,468 | A | 5/1971 | McDevitt |
| 3,581,972 | A | 6/1971 | Buchner et al. |
| 3,670,946 | A | 6/1972 | Croley |
| 3,712,530 | A | 1/1973 | Croley |
| 3,779,157 | A | 12/1973 | Ross et al. |
| 3,785,254 | A | 1/1974 | Mann |
| 3,816,206 | A | 6/1974 | Coster |
| 3,819,085 | A | 6/1974 | Rohowetz |
| 3,836,063 | A | 9/1974 | Sutch |
| 3,846,220 | A | 11/1974 | Buchner |
| 3,861,530 | A | 1/1975 | Calvert |
| 3,868,043 | A | 2/1975 | Freemayer |
| 3,890,762 | A | 6/1975 | Ernst et al. |

(56) References Cited

U.S. PATENT DOCUMENTS

| | | | |
|---|---|---|---|
| 3,908,523 | A | 9/1975 | Shikaya |
| 3,927,766 | A | 12/1975 | Day |
| 3,988,521 | A | 10/1976 | Fumel et al. |
| 4,040,537 | A | 8/1977 | Edwards |
| 4,080,880 | A | 3/1978 | Shikaya |
| RE29,898 | E | 2/1979 | Wheeler |
| 4,146,660 | A | 3/1979 | Hallet et al. |
| 4,150,186 | A | 4/1979 | Kazama |
| 4,150,747 | A | 4/1979 | Gordon |
| 4,163,508 | A | 8/1979 | Mannor |
| 4,170,172 | A | 10/1979 | Wommelsdorf |
| 4,170,674 | A | 10/1979 | Matsuki |
| 4,171,085 | A | 10/1979 | Doty |
| 4,176,054 | A | 11/1979 | Kelley |
| 4,187,137 | A | 2/1980 | Beauchamp |
| 4,187,954 | A | 2/1980 | Striggow |
| 4,200,219 | A | 4/1980 | Ramich |
| 4,228,918 | A | 10/1980 | Kellogg |
| 4,239,125 | A | 12/1980 | Pawlowski |
| 4,243,156 | A | 1/1981 | Lobbestael |
| 4,254,173 | A | 3/1981 | Peer, Jr. |
| 4,261,501 | A | 4/1981 | Watkins |
| D259,231 | S | 5/1981 | Kozlow |
| 4,270,443 | A | 6/1981 | McSwiney et al. |
| 4,300,963 | A | 11/1981 | Berg |
| 4,311,746 | A | 1/1982 | Chavannes |
| 4,319,680 | A | 3/1982 | Hiemstra |
| 4,328,891 | A | 5/1982 | Elward |
| 4,343,259 | A | 8/1982 | McConnel |
| 4,347,934 | A | 9/1982 | Goodman |
| 4,379,014 | A | 4/1983 | Rausing et al. |
| 4,385,997 | A | 5/1983 | Stradal |
| 4,398,650 | A | 8/1983 | Holmes et al. |
| 4,398,904 | A | 8/1983 | Faberberg |
| 4,412,629 | A | 11/1983 | Dart et al. |
| 4,429,825 | A | 2/1984 | Kipp |
| 4,432,488 | A | 2/1984 | Dutcher |
| 4,452,596 | A | 6/1984 | Clauss et al. |
| 4,456,649 | A | 6/1984 | Clarke |
| D275,636 | S | 9/1984 | Picozza |
| 4,495,011 | A | 1/1985 | Scharfemberg et al. |
| 4,505,769 | A | 3/1985 | Auckenthaler |
| 4,511,078 | A | 4/1985 | Rausér et al. |
| D279,850 | S | 7/1985 | Brooker et al. |
| 4,526,316 | A | 7/1985 | Sutherland |
| 4,526,566 | A | 7/1985 | Briand |
| 4,531,996 | A | 7/1985 | Sukenik |
| 4,535,919 | A | 8/1985 | Jameson |
| 4,541,526 | A | 9/1985 | Berg et al. |
| D281,758 | S | 12/1985 | Trombly |
| 4,556,166 | A | 12/1985 | Penttilä |
| 4,558,813 | A | 12/1985 | Richards |
| 4,558,815 | A | 12/1985 | Wischusen, III |
| 4,574,997 | A | 3/1986 | Ikeda |
| 4,578,329 | A | 3/1986 | Holsappel |
| 4,589,569 | A | 5/1986 | Clements |
| 4,617,211 | A | 10/1986 | Fries, Jr. |
| 4,623,072 | A | 11/1986 | Lorenz |
| D287,919 | S | 1/1987 | Clements |
| 4,667,844 | A | 5/1987 | Clauss |
| 4,700,862 | A | 10/1987 | Carter et al. |
| 4,702,496 | A | 10/1987 | Hume, III |
| 4,714,164 | A | 12/1987 | Bachner |
| 4,715,527 | A | 12/1987 | Tsuzuki et al. |
| 4,756,440 | A | 7/1988 | Gartner |
| 4,778,696 | A | 10/1988 | King |
| 4,782,975 | A | 11/1988 | Coy |
| 4,792,086 | A | 12/1988 | Chen |
| 4,836,400 | A | 6/1989 | Chaffey et al. |
| 4,842,906 | A | 6/1989 | Ekdahl et al. |
| 4,858,782 | A | 8/1989 | Yasymuro et al. |
| 4,868,057 | A | 9/1989 | Himes |
| 4,875,585 | A | 10/1989 | Kadleck et al. |
| 4,925,440 | A | 5/1990 | Müller |
| 4,932,531 | A | 6/1990 | Bakx |
| 4,934,591 | A | 6/1990 | Bantleen |
| 4,955,531 | A | 9/1990 | Graboyes |
| 4,961,510 | A | 10/1990 | Dvoracek |
| 4,993,580 | A | 2/1991 | Smith |
| 4,997,125 | A | 3/1991 | Glerum |
| 4,998,666 | A | 3/1991 | Ewan |
| 5,000,788 | A | 3/1991 | Stotler |
| 5,001,179 | A | 3/1991 | Kauffman et al. |
| 5,029,749 | A | 7/1991 | Aloisi |
| 5,067,887 | A | 11/1991 | Speer et al. |
| 5,078,313 | A | 1/1992 | Matheson |
| 5,092,485 | A | 3/1992 | Lee |
| 5,098,962 | A | 3/1992 | Bozich |
| 5,102,036 | A | 4/1992 | Orr et al. |
| 5,111,957 | A | 5/1992 | Hollander et al. |
| 5,145,107 | A | 9/1992 | Silver et al. |
| 5,203,492 | A | 4/1993 | Schellenberg |
| 5,205,473 | A | 4/1993 | Coffin |
| 5,209,367 | A | 5/1993 | Van Musscher et al. |
| 5,222,656 | A | 6/1993 | Carlson |
| 5,226,585 | A | 7/1993 | Varano |
| 5,229,182 | A | 7/1993 | Eisman et al. |
| D339,027 | S | 9/1993 | Mack et al. |
| 5,244,093 | A | 9/1993 | Carmichael et al. |
| 5,253,781 | A | 10/1993 | Van Melle et al. |
| 5,256,131 | A | 10/1993 | Owens et al. |
| 5,259,529 | A | 11/1993 | Coale |
| 5,326,019 | A | 7/1994 | Wolff |
| 5,363,982 | A | 11/1994 | Sadlier |
| 5,385,260 | A | 1/1995 | Gatcomb |
| 5,398,842 | A | 3/1995 | Sokolski et al. |
| 5,398,843 | A | 3/1995 | Warden et al. |
| 5,415,339 | A | 5/1995 | Howard |
| 5,425,497 | A | 6/1995 | Sorensen |
| 5,429,239 | A | 7/1995 | Baxter |
| D363,641 | S | 10/1995 | Goto et al. |
| 5,454,484 | A | 10/1995 | Chelossi |
| 5,458,723 | A | 10/1995 | Watkins et al. |
| 5,460,323 | A | 10/1995 | Titus |
| 5,460,324 | A | 10/1995 | Vinther |
| D363,852 | S | 11/1995 | Young |
| D364,071 | S | 11/1995 | Lynd |
| 5,469,983 | A | 11/1995 | Yawata |
| 5,484,059 | A | 1/1996 | Sutherland |
| 5,487,506 | A | 1/1996 | Drummond et al. |
| 5,490,631 | A | 2/1996 | Iioka et al. |
| D368,624 | S | 4/1996 | Forrer |
| 5,509,568 | A | 4/1996 | Warden et al. |
| 5,524,817 | A | 6/1996 | Meier et al. |
| 5,542,599 | A | 8/1996 | Sobol |
| 5,547,124 | A | 8/1996 | Mueller |
| 5,620,135 | A | 4/1997 | Stahlecker et al. |
| 5,628,453 | A | 5/1997 | MacLaughlin |
| D379,928 | S | 6/1997 | Freek et al. |
| 5,660,326 | A | 8/1997 | Varano et al. |
| 5,685,480 | A | 11/1997 | Choi |
| 5,697,550 | A | 12/1997 | Varano et al. |
| 5,697,750 | A | 12/1997 | Varano et al. |
| 5,713,512 | A | 2/1998 | Barrett |
| 5,725,916 | A | 3/1998 | Ishii et al. |
| 5,746,372 | A | 5/1998 | Spence |
| 5,750,235 | A | 5/1998 | Yoshimasa |
| 5,752,653 | A | 5/1998 | Razzaghi |
| RE35,830 | E | 6/1998 | Sadlier |
| 5,759,624 | A | 6/1998 | Neale et al. |
| 5,765,716 | A | 6/1998 | Cai et al. |
| 5,766,709 | A | 6/1998 | Geddes et al. |
| 5,769,311 | A | 6/1998 | Morita et al. |
| 5,775,577 | A | 7/1998 | Titus |
| 5,794,842 | A | 8/1998 | Hallam |
| 5,794,843 | A | 8/1998 | Sanchez |
| 5,810,243 | A | 9/1998 | DiPinto et al. |
| 5,839,653 | A | 11/1998 | Zadravetz |
| 5,857,615 | A | 1/1999 | Rose |
| 5,865,480 | A | 2/1999 | Bain, Jr. et al. |
| 5,927,502 | A | 7/1999 | Hunter |
| 5,928,764 | A | 7/1999 | Costi |
| 5,950,917 | A | 9/1999 | Smith |
| 5,952,068 | A | 9/1999 | Neale et al. |

(56) References Cited

U.S. PATENT DOCUMENTS

| | | | |
|---|---|---|---|
| 5,964,400 | A | 10/1999 | Varano et al. |
| 6,039,682 | A | 3/2000 | Dees et al. |
| 6,068,182 | A | 5/2000 | Tokunaga |
| 6,085,970 | A | 7/2000 | Sadlier |
| 6,109,518 | A | 8/2000 | Mueller et al. |
| 6,116,503 | A | 9/2000 | Varano |
| 6,126,584 | A | 10/2000 | Zadravetz |
| 6,139,665 | A | 10/2000 | Schmelzer et al. |
| 6,142,331 | A | 11/2000 | Breining et al. |
| 6,179,203 | B1 | 1/2001 | Toussant et al. |
| 6,186,394 | B1 | 2/2001 | Dees et al. |
| 6,193,098 | B1 | 2/2001 | Mochizuki et al. |
| 6,196,454 | B1 | 3/2001 | Sadlier |
| 6,213,293 | B1 | 4/2001 | Marco |
| 6,224,954 | B1 | 5/2001 | Mitchell et al. |
| 6,250,005 | B1 | 6/2001 | Richards |
| 6,250,545 | B1 | 6/2001 | Mazzarolo et al. |
| 6,253,995 | B1 | 7/2001 | Blok et al. |
| 6,257,485 | B1 | 7/2001 | Sadlier et al. |
| 6,260,756 | B1 | 7/2001 | Mochizuki et al. |
| 6,265,040 | B1 | 7/2001 | Neale et al. |
| 6,267,837 | B1 | 7/2001 | Mitchell et al. |
| 6,277,454 | B1 | 8/2001 | Neale et al. |
| 6,287,247 | B1 | 9/2001 | Dees et al. |
| 6,290,091 | B1 | 9/2001 | Bell |
| 6,308,883 | B1 | 10/2001 | Schmelzer et al. |
| 6,343,735 | B1 | 2/2002 | Cai |
| 6,378,766 | B2 | 4/2002 | Sadlier |
| 6,416,829 | B2 | 7/2002 | Breining et al. |
| 6,419,105 | B1 | 7/2002 | Bruce et al. |
| 6,422,456 | B1 | 7/2002 | Sadlier |
| 6,450,398 | B1 | 9/2002 | Muise et al. |
| 6,565,934 | B1 | 5/2003 | Fredricks et al. |
| 6,568,585 | B2 | 5/2003 | Marie |
| 6,586,075 | B1 | 7/2003 | Mitchell et al. |
| 6,595,409 | B2 | 7/2003 | Hashimoto et al. |
| 6,598,786 | B1 | 7/2003 | Guo |
| 6,620,281 | B1 | 9/2003 | Sommers |
| 6,663,926 | B1 | 12/2003 | Okushita et al. |
| 6,663,927 | B2 | 12/2003 | Breining et al. |
| 6,703,090 | B2 | 3/2004 | Breining et al. |
| 6,729,534 | B2 | 5/2004 | Van Handel |
| 6,749,913 | B2 | 6/2004 | Watanabe et al. |
| 6,811,843 | B2 | 11/2004 | DeBraal et al. |
| 6,852,381 | B2 | 2/2005 | Debraal et al. |
| 6,926,197 | B2 | 8/2005 | Hed et al. |
| 7,045,196 | B1 | 5/2006 | Hill |
| 7,281,650 | B1 | 10/2007 | Milan |
| 7,536,767 | B2 | 5/2009 | Hollis et al. |
| 7,549,273 | B2 | 6/2009 | Dart et al. |
| 7,699,216 | B2 | 4/2010 | Smith et al. |
| D621,659 | S | 8/2010 | Liu |
| 7,856,793 | B2 | 12/2010 | Dart et al. |
| 2001/0048022 | A1 | 12/2001 | Zoeckler |
| 2003/0071045 | A1 | 4/2003 | Taylor |
| 2004/0140047 | A1 | 7/2004 | Sato et al. |
| 2005/0227029 | A1 | 10/2005 | Dart et al. |
| 2005/0236468 | A1 | 10/2005 | Sadlier |
| 2006/0118608 | A1 | 6/2006 | Stahlecker |
| 2006/0131316 | A1 | 6/2006 | Bresler |
| 2006/0144915 | A1 | 7/2006 | Sadlier |
| 2006/0289610 | A1 | 12/2006 | Kling |
| 2008/0087716 | A1 | 4/2008 | Sadlier |
| 2008/0098698 | A1 | 5/2008 | Dart et al. |
| 2009/0229221 | A1 | 9/2009 | Dart et al. |

FOREIGN PATENT DOCUMENTS

| | | | | |
|---|---|---|---|---|
| DE | 1912705 | A1 | | 10/1969 |
| DE | 1786171 | | | 2/1972 |
| DE | 2330767 | | | 1/1975 |
| DE | 2331005 | | | 1/1975 |
| DE | 2418141 | A1 | | 10/1975 |
| EP | 0371918 | A1 | | 6/1990 |
| FR | 993163 | | | 10/1951 |
| FR | 1373348 | | | 10/1963 |
| FR | 2206240 | | | 6/1974 |
| FR | 2397987 | | | 2/1979 |
| FR | 2481229 | | | 10/1980 |
| FR | 2 733 209 | | | 10/1996 |
| GB | 604794 | | | 7/1948 |
| GB | 649299 | | | 1/1951 |
| GB | 958388 | | | 5/1964 |
| GB | 1167861 | | | 10/1969 |
| GB | 1366310 | | | 9/1974 |
| GB | 2016640 | A | | 9/1979 |
| GB | 2294021 | B | | 8/1998 |
| IT | 334302 | | | 1/1936 |
| JP | 52076765 | A | | 6/1977 |
| JP | 52-14830 | | | 12/1977 |
| JP | 52-148380 | | * | 12/1977 |
| JP | 57-6333 | | | 2/1982 |
| JP | 61-142419 | A | | 6/1986 |
| JP | 4-5036 | | | 1/1992 |
| JP | 4-6036 | | | 1/1992 |
| JP | 4-41815 | | | 4/1992 |
| JP | 4-97018 | | | 9/1992 |
| JP | 5-4670 | | | 1/1993 |
| JP | 6-22212 | | | 3/1994 |
| JP | 6-39717 | | | 5/1994 |
| JP | 6-61773 | | | 8/1994 |
| JP | 6-78215 | | | 11/1994 |
| JP | 7-189138 | | | 7/1995 |
| JP | 20000025740 | A | | 1/2000 |
| JP | 2003276738 | A | | 10/2003 |
| NL | 291640 | | | 7/1965 |
| RU | 2142878 | C1 | | 12/1999 |
| WO | 2010/109000 | A2 | | 9/2010 |

OTHER PUBLICATIONS

Marilyn Bakker, The Wiley Encyclopedia of Packaging Technology, 1986, 66-69; USA.

Office Action for U.S. Appl. No. 12/829,587 mailed Mar. 30, 2011.

* cited by examiner

INSULATING CUP WRAPPER AND INSULATED CONTAINER FORMED WITH WRAPPER

CROSS-REFERENCE TO RELATED APPLICATIONS

This patent issued from an application that is a continuation-in-part (CIP) of my application Ser. No. 11/098,853, filed 4 Apr. 2005, now abandoned, which is in turn a CIP of my application Ser. No. 10/831,411, filed 22 Apr. 2004, now abandoned.

BACKGROUND

1. Field of Invention

This invention relates generally to insulating disposable cups and containers, specifically to insulating wrappers, methods for producing insulating wrappers, and methods for making insulated containers with insulating wrappers.

2. Prior Art

Many types of cups and containers are available, each with a specific set of characteristics relating to print quality, rigidity, insulation, biodegradability, recyclability, clarity, permeability, microwavability, and shelf life, among other characteristics. Many types of cups have desirable features and benefits in one or more areas, but undesirable features in other areas.

E.g., cups made from expanded polystyrene (EPS), well known in the art, are excellent thermal insulators and maintain the temperature of a drink, whether hot or cold, for a long period of time. They also provide a barrier between the hot or cold temperature of the product and the user's hand. However EPS cups are generally considered environmentally unfriendly because they are not biodegradable. As a result, their use has been banned in some municipalities. Also, in order to print EPS cups a slow and costly off-line printing process must be used because the cups must be printed after they have been formed, and their relatively rough surface does not permit high-resolution printing.

Standard single-wall paper containers, also well known in the art, are generally considered to be more environmentally friendly than EPS cups, but they have poor insulating qualities. As such, many coffee shops resort to double cupping, which is the practice of serving a hot beverage in two stacked single-wall paper cups in order to provide some level of insulation. This is a very expensive and wasteful. Alternatively, designers have provided a number of cup sleeves which are wrapped around a single wall paper cup to provide insulation to keep drinks hot and hands comfortable; see, e.g., U.S. Pat. No. 5,205,473 to Coffin (1993), U.S. Pat. No. 5,794,843 to Sanchez (1998), and U.S. Pat. No. 6,277,454 to Neale et al (2001). One of the shortcomings of cup sleeves is that they must be assembled and/or placed onto the cup when the beverage is served. This requires extra labor and slows the speed of service. Also the need for cups and sleeves require additional and simultaneous purchasing, additional storage space, and additional inventory management. Cup sleeves also have a tendency to fall off of the cups, do not conveniently fit in all vehicle cup holders, and cover the graphics printed on the cup.

Single-wall plastic cups made from materials such as polyethylene terephthalate (PET), polystyrene (sometimes called PETE), (PS), polypropylene (PP), and high density polyethylene (HDPE) are well known in the art, and are formed through either thermoforming or injection molding processes. Plastic cups are aesthetically pleasing and can be made with high barrier properties to offer longer shelf life to the products that they contain. A barrier material called EVOH (Ethylene Vinyl Alcohol Polymer) can also be added to provide a better oxygen barrier. A cup made from a thick layer of HDPE will provide a significant moisture barrier. Plastic cups made with both HDPE and EVOH are resistant to both moisture and oxygen to provide extended shelf life to the products they contain. Some types of plastic cups, such as those made from polypropylene, are resistant to high levels of heat and as such are microwavable. Also, plastic cups do not have a seam area, which makes them relatively leak proof. However plastic cups must be printed off-line after the cup is formed, which is an expensive process and limits the graphic capabilities. Another problem is that these cups are poor thermal insulators. They will loose their heat or cool very quickly, and are uncomfortable to carry when holding hot or cold contents. Another deficiency is that their sidewall rigidity strength is poor.

Multi-layered paper cups have been designed to provide thermal insulation and increased strength. U.S. Pat. No. 3,908,523 to Shikaya (1975), U.S. Pat. No. 5,205,473 to Coffin (1993), U.S. Pat. No. 5,547,124 to Mueller (1996), U.S. Pat. No. 5,685,480 Choi (1997), U.S. Pat. No. 5,769,311 Morita et al. (1998), U.S. Pat. No. 5,775,577 Titus (1998), U.S. Pat. No. 6,039,682 Dees et al. (2000) and U.S. Pat. No. 6,253,995 Blok et al. (2001) all show multilayered cups with at least three layers, which include some form of an inner cup made from paper and an outer cover or wrapper to provide insulation. The wrapper comprises a multi-ply sheet consisting of at least one base sheet, and at least one corrugated or embossed sheet adhered to the base sheet. Although thermally insulated and strong, these cups are expensive to manufacture because the corrugated or embossed sheet must be adhered to cover the entire surface of the base sheet through a lamination process. This is a process whereby adhesive, such as hot melt or heated polyethylene, or a paste adhesive such as a starch based cold glue, is applied either to the surface of the embossed sheet and/or the base sheet and the two sheets are pressed together forming a multi-ply insulating sheet. The wrapper is then cut out (a process called blanking) of this multi-ply sheet and wrapped around and adhered to an inner cup. The process of laminating the sheets together is expensive and wasteful. There is a significant amount of value-added multi-ply sheet trim scrap which is wasted when blanking the wrapper. There is also a significant amount of adhesive used to secure the embossed sheet across the entire surface of the base sheet, which is typically done along all of the tips of the corrugations or embossments. The printing process is expensive because either the base sheet must be printed prior to laminating, which causes significant registration and distortion issues after the sheets are laminated together, or the multi-ply sheet is printed after the sheets are laminated, which is difficult because of the thickness and stiffness of the multiply sheet and the excess compressibility of the sheet. In any event, it is very difficult to offer high quality printing at a cost effective price on these types of insulated cups. Finally it is difficult to wrap or bend the multi-ply laminated wrapper around an inner cup because of the limited flexibility of thick laminated paperboard.

The insulated cups of U.S. Pat. No. 5,660,326 to Varano and Sadlier (the present inventor) (1997), and U.S. Pat. No. 6,085,970 to Sadlier (2000) have overcome these deficiencies. These cups have gained widespread acceptance in the market and many millions have been sold throughout the world. Although the cups of these two patents are major improvements, I have discovered that both the cups and their manufacturing processes can be improved even further. Since the inner cup and the outer layer are made from a continuous blank, these two parts are made from the same material. This is disadvantageous since the inner layer must be made from expensive polyethylene coated board for waterproofing and thus the outer layer must also be made from this same expensive material. Also, since the inner and outer layers are made from the same blank, the entire blank, rather than just the outer portion of the blank, must be passed through a printing press, which is a relatively expensive processing operation. The sidewall blank must also be folded in order to form the inner and outer layers of the cup from the same elongated blank. The process of folding the blank is an expensive additional step which requires precise registration.

OBJECTS AND ADVANTAGES

Accordingly, several objects and advantages of the invention are to provide an improved cup that has (a) improved thermal insulating properties and rigidity. Also it can (b) be made of less costly materials, (c) be made more leak resistant, (d) extend the shelf life of the drink it contains, (e) be microwaved, (f) be made with recycled materials, (g) be made from the most economical materials for each part to save costs, (h) be printed more economically, (i) be made without folding, and (j) be assembled at very rapid speed with high-speed fabrication machinery. Further objects and advantages will be apparent from a consideration of the ensuing description and accompanying drawings.

SUMMARY

In accordance with one embodiment of the invention, a thermally insulated container is formed from a single-walled paper or plastic inner cup and an insulating outer wrapper. The insulating outer wrapper comprises a paper base sheet or outer sidewall blank, optionally printed on one side, and a corrugated paper insert. The insert is similar in shape to the outer sidewall blank but its size is smaller than that of the sidewall blank. The insert is glued in a centered position of the non-printed side of the sidewall blank to form a two-layered insulating wrapper. The two-layered wrapper is then wrapped around a single walled inner cup, which is positioned on a forming mandrel for support, with the insert to the inside and the printed side of the blank to the outside. The side edges of the wrapper overlap and are sealed together to form a side seam. The insert or the side seam is itself adhesively secured to the inner cup. The manufacturer can use other methods to adhere the inner cup to the wrapper. E.g., they can use one or more beads of cold glue (paste adhesive). Also they can pre-apply a thin layer of polyethylene (or similar heat sealing material) to the inside cut edges of the sidewall blank. This is then heat-activated-immediately prior to wrapping the wrapper around the inner cup, and pressing the overlapping side seam to the sidewall of the inner cup to glue it in place.

DRAWINGS

Figures

DRAWINGS

Reference Numerals

| | |
|---|---|
| 10 side wall | 10R upper rim |
| 10B bottom | 12 base sheet |
| 12G glue spot | 12SG seam glue |
| 14 corrugated insert | 14F foamed plastic insert |

DETAILED DESCRIPTION

Figure 1:
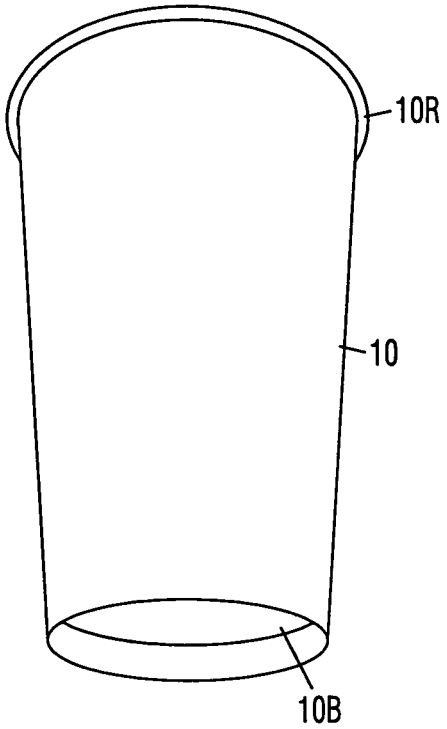
Fig. 1 Prior Art
FIG. 1 is a perspective view of a prior-art plain single-walled paper or plastic cup.

FIG. 1—Prior-Art Cup

FIG. 1 shows a view from below of a prior-art paper or plastic cup. The cup comprises a sidewall 10 an upper rim 10R, and a bottom 10B, and is made of a single wall of plastic or plastic-coated paper. As a result it has poor insulating qualities. Thus if it contains a hot beverage (not shown) the heat will pass through the cup and heat or burn the fingers of anyone who holds it. The cup could be made of an insulating material, such expanded polystyrene (EPS), a foamlike thick material, but EPS cups are generally considered environmentally deleterious because they are not biodegradable and thus their use has been banned in some areas. Also manufacturers find it difficult to print trademarks and other messages on them. The cup can be doubled, but this is an expensive and wasteful practice. A cup sleeve can be slid over the cup, but this requires additional labor, time, storage, and inventory management, and sleeves have a tendency to fall off, do not conveniently fit in all cup holders, and cover any graphics printed on the cup. Multi-layered cups have been provided, but these have numerous disadvantages, as noted above.

If made from paper, the cup is preferably made from solid bleach sulfite (SBS) paperboard which is coated on at least one side with polyethylene or any other suitable water proof material. The process of making such a single-walled paper cup is well-known in the art. It has a vertical side seam (not shown) that runs from the bottom to the top of the cup. Different material combinations and thicknesses can be used to achieve certain properties. For example, if an insulated cup with a long shelf life is required, the paper cup can be coated with a layer of foil on the inside. Foil provides a great moisture and oxygen barrier to preserve the contents of the liquid within. Alternatively, different thermoplastic barrier materials can be coated onto the paper. E.g., HDPE and EVOH provide moisture and oxygen barriers, respectively. If more sidewall strength is required, the paper can be made thicker. If the insulated cup is to be microwaved a waterproof material with a high melting point, such as medium to high density polyethylene, can be used.

If made from plastic, the cup may not have a side seam, and can be formed from any of a number of materials, or combination of materials, such as PET, PP, PS, and/or HDPE. The process of making single-wall plastic cups from a thermoforming or injection molding process is well known. Different material combinations and thicknesses can be used to achieve certain properties. For example, if an insulated cup with a long shelf life is required, the plastic cup can be made from a combination of HDPE and EVOH. The HDPE provides a moisture barrier which increases with the thickness of the material, and the EVOH provides an oxygen barrier. If a microwavable container is required, HDPE or PP can be used, both of which are resistant to high levels of heat.

Insulating Outer Wrapper

Figure 2:
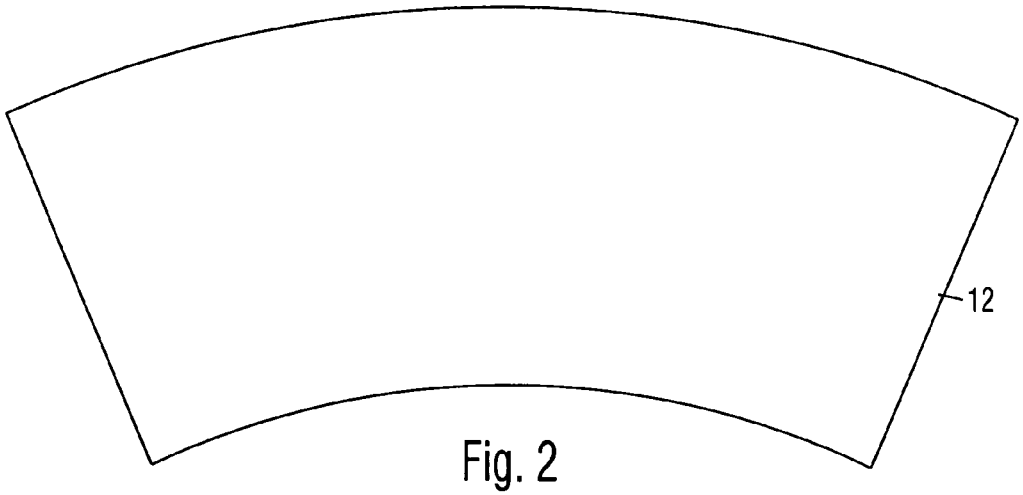
FIG. 2 is a plan view of a flat paper base sheet used in an outer wrapper according to the invention.
Figure 3A:
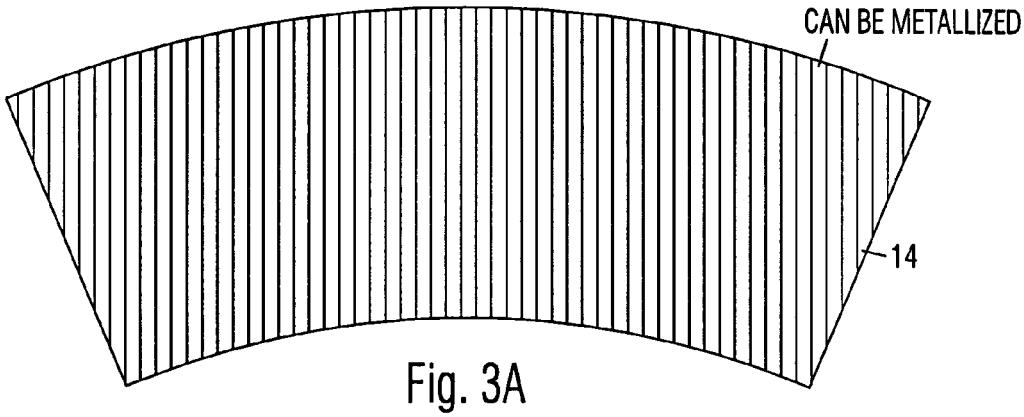
FIG. 3A is a plan view of a corrugated paper insert which is attached to the base sheet.
Figure 3B:
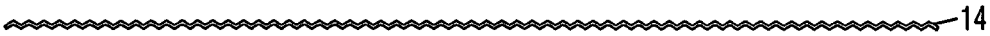
FIG. 3B is an edge view of the corrugated paper insert of FIG. 3A.
Figure 4A:
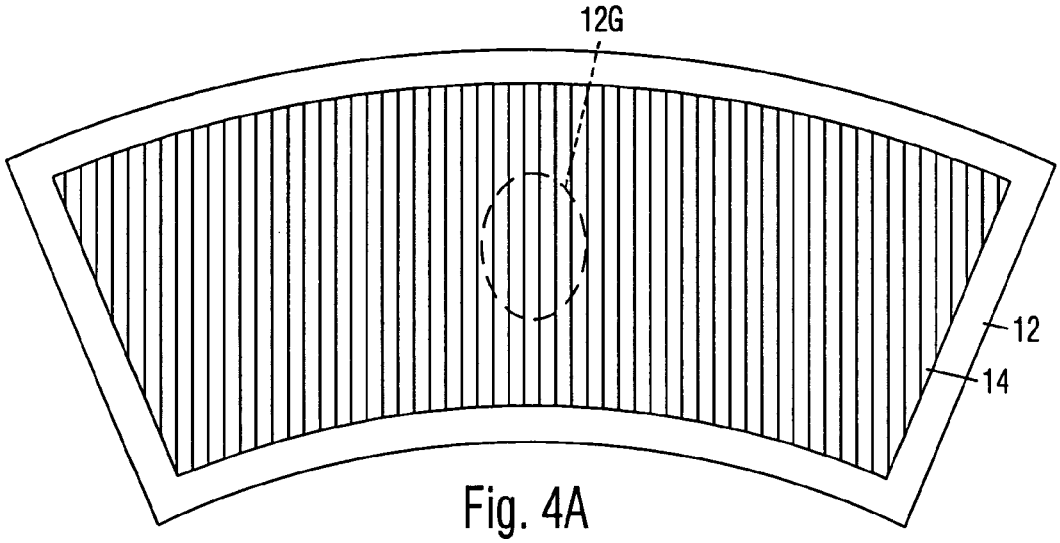
FIG. 4A is a view of an outer wrapper consisting of an assembly of the base sheet and corrugated insert.

FIGS. 2 to 4

In accordance with the invention, I provide an insulating outer wrapper for use with the cup of FIG. 1. The wrapper comprises a base sheet or layer 12 (FIG. 2) and an insert, sheet, or layer 14 (FIGS. 3A and 3B) which is attached to the base sheet. Both sheets have the same shape, which is generally rectangular with four bounding edges. Two of the edges are opposite side edges that are oriented at an acute angle to each other, while the other two of the edges are opposite top and bottom edges that are curved and are oriented concentrically to each other. Layer 14 has corrugations or other multiple distortions so as to cause it to be thicker than the basic thickness of its material, thereby significantly increasing its insulating properties and creating an insulating layer.

Presently for base sheet 12 I prefer to use Solid Bleach Sulfite (SBS) paper, 0.20 mm to 0.50 mm thick. The base sheet is cut or blanked from a larger starting sheet or roll (not shown) and has a cut edge along the top and bottom arcs, and along each side. If the finished cup is to bear a trademark and/or other printing, base sheet 12 should be printed prior to being blanked from the larger starting sheet or roll. The base sheet can be clay-coated in well-known fashion on the print side to improve the smoothness and brightness of the printing surface.

Corrugated insert 14 is formed by passing a flat sheet of paper (preferably plate stock paperboard, cup stock, Kraft paper, or linerboard which is 0.12 mm to 0.50 mm thick, and optionally coated with a layer of reflective material such as metallized film or foil as indicated) through an embossing or corrugating die (not shown), and then cut to size in well-known fashion. Similar to the base sheet, the corrugated insert has a cut edge along the top and bottom arcs, and along each side. I prefer to form the corrugations with a pitch (spacing between tops of adjacent ribs) of between 2.5 mm to 7.6 mm. The depths of the corrugations are 0.5 mm inch to 1.27 mm. Insert 14 is about 30% smaller in area than that of base sheet 12. Due to the smaller size of the insert, if it is not precisely centered on the base sheet as often happens with high-speed assembling machinery, the insulating outer wrapper will still be useable since the base sheet will still extend beyond the edges of the insert.

Figure 4B:
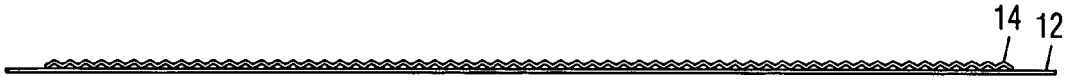
FIG. 4B is an edge view of the outer wrapper.

Base sheet 12 and corrugated insert 14 are adhered together (FIGS. 4A and 4B) to form an insulating outer wrapper or assembly by placing a small amount of glue 12G in a central area of, and centered on, the base sheet, and attaching the insert. If the insert material has a reflective coating on one side, the reflective side would be positioned to face away from the base sheet. Preferably less than 20% of the area of the insert is adhesively attached to the base sheet. Note that since the insert sheet is smaller than the base sheet, edge portions of the base sheet extend beyond the edges of the insert. I presently prefer to use hot melt adhesive because of its fast set time. Alternatively the adhesive can be placed on the corrugated insert. As a further alternative, several glue spots can be used in a central area of the base sheet to provide more stability to the insert as it is attached with high speed machinery. Unlike the prior art corrugated cups, it is not necessary to use a large volume of glue to adhere each of the tips of the corrugations to the base sheet as mentioned above I prefer to glue less than 20% of the area of the corrugated insert to the base sheet. In particular, no glue is applied to the area adjacent to the cut side edges of the insert so that these edges are free. The overall thickness of the finished insulating outer wrapper, indicated in FIG. 4B, is between 1 mm to 2 mm thick.

Container with Insulating Outer Wrapper

Figure 5:
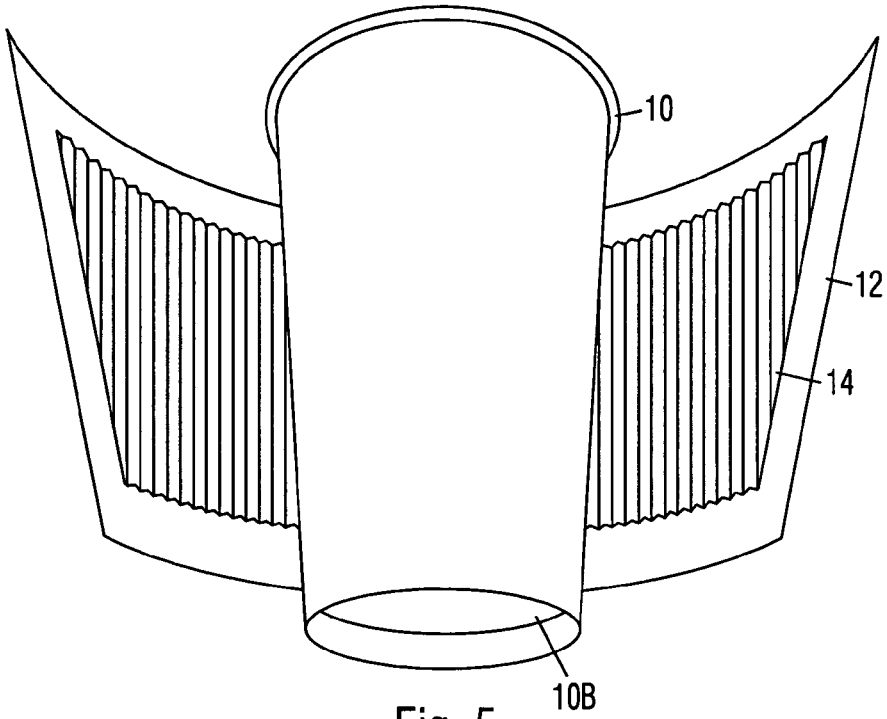
FIG. 5 is a perspective view of the outer wrapper being wrapped around a cup.

FIGS. 5 and 6

As shown in FIG. 5, the insulating outer wrapper or assembly of base sheet 12 and corrugated insert 14 is assembled to the outside of cup 10 of FIG. 1 by placing the cup on a mandrel (not shown) and wrapping the insulating outer wrapper around the cup. This can be done by well-known automated machinery. When the outer wrapper is wrapped or curled in the manner shown in FIG. 5, the right and left cut side ends of the inner or upper layer (insert 14) will tend to migrate outwardly on the outer or lower layer (base sheet 12). If the two layers were glued together over their entire areas, curling or wrapping the assembly would tend to kink the insert, tear the base layer, or pull the glued joint apart. Since insert 14 is not attached to base sheet 12 along the side edges, the edges of the insert can migrate freely and such undesirable results will not occur.

Figure 6A:
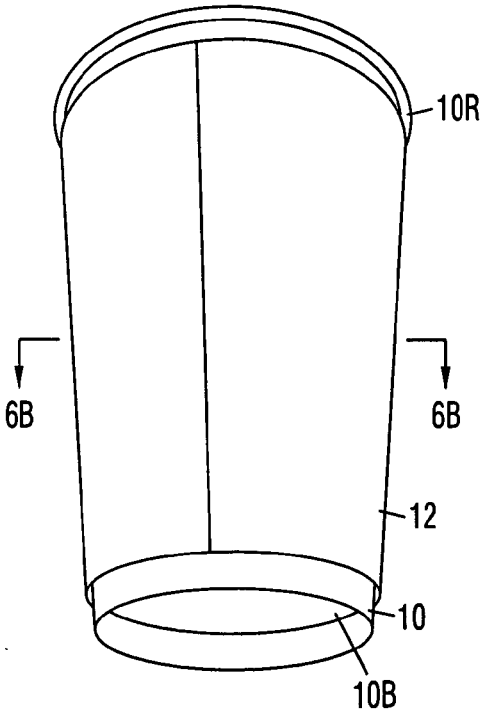
FIG. 6A is an elevational view of the wrapped cup and FIG. 6B is a sectional view taken as indicated by lines 6B-6B in FIG. 6A.
Figure 6B:
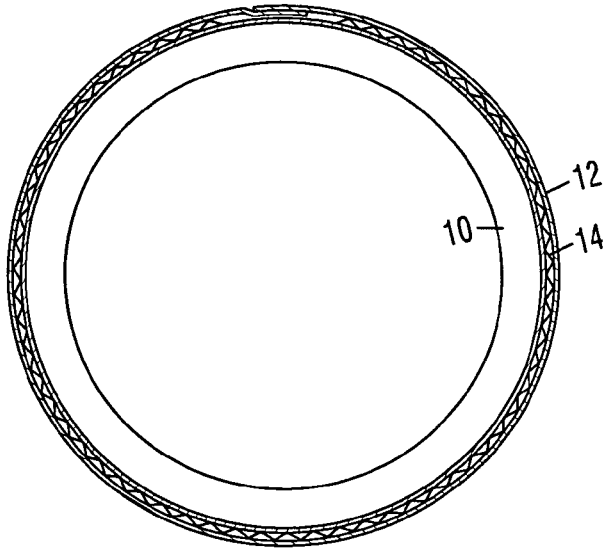

When the insulating outer wrapper is fully wrapped around the cup as shown in FIGS. 6A and 6B, the free cut edges of base layer 12 overlap and are glued together. This is done in any of a number of ways. Preferably one or more beads of paste adhesive or hot melt adhesive are applied to the overlapping edges of the base sheet and then pressed together. Alternatively a layer of heat-activated adhesive, such as polyethylene, can be pre-applied to the area adjacent the cut edges of the base sheet and then heat activated to seal the edges when they are overlapped and pressed together. The insulating outer wrapper is itself adhered to the cup side wall along the wrapper's vertical side seam area. This is done by applying paste adhesive, hot melt adhesive, or a pre-applied heat-activated polyethylene layer to the inside surface of the side seam, which is then attached directly to the cup, or to a vertical strip on the outside of the cup, to which the side seam is then attached. The adhesive that attaches the side edges of the base sheet together, and the adhesive that attaches the side edges of the base sheet to the cup, are not shown in FIG. 6B.

In lieu of a thin layer of adhesive, a foaming adhesive can be used to attach the overlapping edge areas of the base sheet to the cup. One suitable foaming adhesive is sold under the trademark Airsperse adhesive by H. B. Fuller Co., of St. Paul, Minn.; this glue contains micro cells of air to provide a micro cell insulating compound (not shown) that would space the overlapping side edges of the base sheet from the cup and provide insulating properties.

The resultant insulated container of FIGS. 6A and 6B can contain a hot beverage, yet can be held with one's bare hands. Very little glue is needed since only a vertical strip of the wrapper (along the side seam) and the cup are glued. Note that the overlapping edges of base layer 12 are in contact with each other and with cup 10. The cut edges of corrugated insert 14 do not come between the overlapping side seam of base sheet 12 and cup 10 since the corrugated insert is shorter than base sheet 12. Thus it does not interfere with the gluing of base sheet 12 to cup 10. Another advantage of this is that it reduces the overall thickness of the sidewall of finished insulated container. If standard corrugated board were wrapped around a cup, there would be a double thickness of the corrugated board at the overlapping side seam. This extra thickness at the side seam would prevent the cups from nesting one into one another. But by only having the base sheet overlap at the side seam the overall thickness of the finished cup is not increased. Additionally the manufacturer can glue the corrugated insert, and thus the insulated wrapper, to cup 10 at one or more circumferential locations around the cup for added stiffness and strength.

I presently prefer to attach the insulating outer wrapper to cup 10 about 2.0 mm down from rim 10R so as to leave a an exposed area at the top of the cup directly under the rim, but the wrapper can be attached directly under the rim, or spaced farther down. I have designed the dimensions of the insulated wrapper such that it does not cover the entire vertical length of the cup. It is spaced up from the bottom of the cup by approximately 1.6 cm to leave that area of the cup's base exposed. Alternatively it can be sized to cover the entire outside of cup 10, except for rim 10R. The wrapper can also be sized to mimic the look of a cup sleeve wrapped around a cup, whereby the cup side wall would be exposed above and below the wrapper. The wrapper should just be large enough to cover and thus insulate any area which will be held by the user.

The outside of the container can be printed more easily since only base layer 12 need be passed though the printer. While cup 10 should be made of waterproof material (plastic or plastic-coated paper), the outer insulating wrapper need not be made of this expensive material since it does not contact the liquid and is not part of cup 10.

Container with Foamed Plastic Insert

FIG. 7

Figure 7:
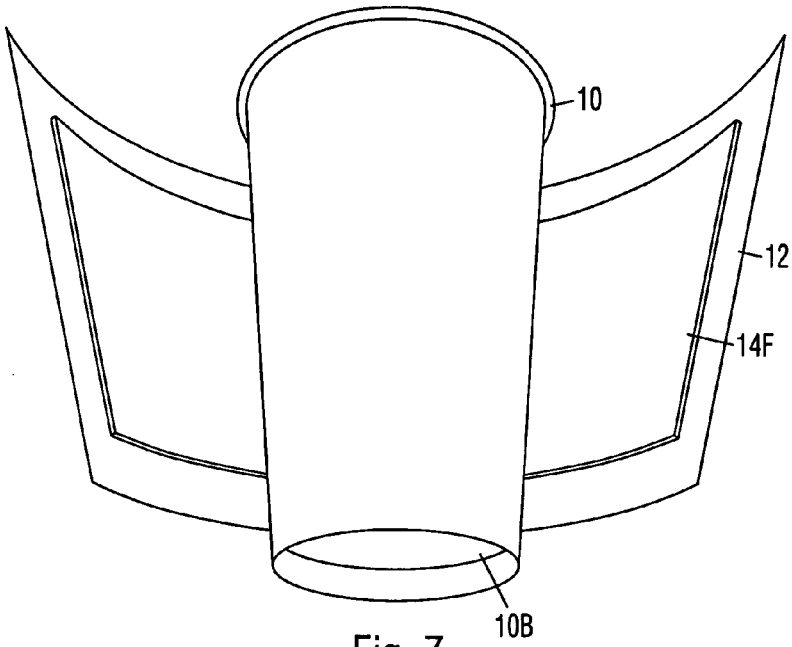
FIG. 7 is a perspective view of the outer wrapper being wrapped around a cup with a foamed plastic insert.

In lieu of a corrugated paper insert 14 (FIGS. 3A to 5 and 6B), the insert can be made of a layer of foamed plastic 14F, as shown in FIG. 7. Layer 14F preferably is made of foamed PS, but also can be made of foamed polyethylene, foamed PET, or any other closed or open cell foamed plastic. A closed cell foam structure provides better insulation than an open cell structure. Therefore I presently prefer to use a closed cell foam material such as extruded foam polystyrene. The blowing agent (gas) in the foam (such as $CO_2$ or butane) can also be varied to effect the insulation. I prefer to use a blowing agent that provides superior insulation. Layer 14F preferably is 0.5 mm to 1.5 mm thick. The insulating qualities of layer 14F are comparable and even better in some cases to those of corrugated layer 14, yet it can be adhered to outer layer 12 and curled in the same manner as layer 14.

Gluing of Insert to Cup

Figure 8A:
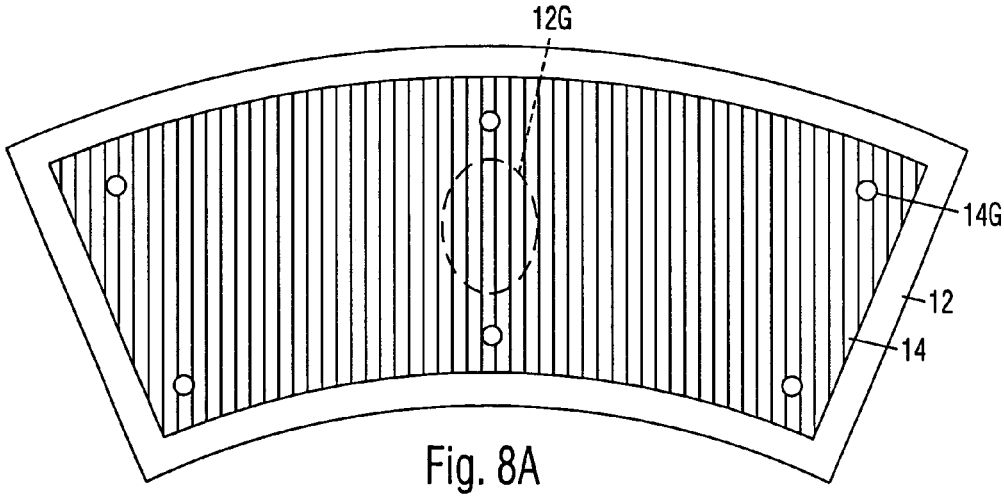
FIG. 8A is a view of an outer wrapper consisting of an assembly of the base sheet and corrugated insert, with glue spots applied to the insert for attaching the wrapper to the cup.
Figure 8B:
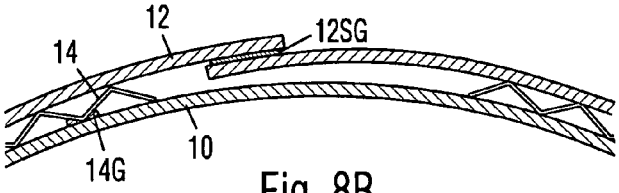
FIG. 8B is a cross-sectional view from above of the seam area of a cup showing part of the wrapper of FIG. 8A attached to the cup.

FIGS. 8A and 8B

In lieu of gluing the edge area of the base sheet to the cup (FIGS. 6A and 6B), the insert sheet (corrugated or foam) can be glued to the cup by applying several areas of glue 14G (FIG. 8A) to the insert sheet or to the outside of the cup and then attaching the wrapper (adhered insert and base sheet) to the cup. FIG. 8B shows an enlarged sectional view from above of the seam area of cup 10 and the adjacent part of the wrapper. Specifically FIG. 8B shows one spot of glue 14G attaching insert sheet 14 to cup 10 and seam glue 12SG attaching the side edges of base sheet 12 together. Note that the attached overlapping edge areas of the base sheet are attached together, but are separated from the cup by air space, which is insulating. In lieu of such air space, the foaming Airsperse adhesive, supra, can be used to attach the overlapping edge areas of the base sheet to the cup, in addition to attaching the insert to the cup. Such adhesive (not shown) would fill the gap between the overlapping side edges of the base sheet and the cup.

CONCLUSION, RAMIFICATIONS, AND SCOPE

Accordingly the reader will see that, according to the invention, I have provided a container with improved thermal insulating properties and rigidity, and that also uses less costly materials, is cheaper to make, is more leak resistant, extends the shelf life of the liquid it holds, is microwavable, can be made from a higher content of recycled content, can be made from the most economical materials for each part to save costs, does not require folding, and can be printed more economically. Wrapping the insulated wrapper around a single wall plastic cup will provide an insulated cup that, depending upon the plastic material of the inner cup, can be leak proof, have extended shelf life, be microwavable, provide rigidity to the plastic cup, provide better graphics to the plastic cup, and will be potentially be less expensive than wrapping it around a single wall paper cup (depending upon the type of plastic material and thickness used). Due to the overlap of the base layer, the insulating layer does not interfere with the gluing of the base layer to itself or to the cup.

While the above description contains many specificities, these should not be construed as limitations on the scope of the invention, but as exemplifications of the presently preferred embodiments thereof. Many other ramifications and variations are possible within the teachings of the invention. For example, although not necessary, the insulating insert, and thus the insulated wrapper, can also be adhesively attached to the sidewall of the inner cup in one or more locations, as this will provide more rigidity to the finished cup. The insulating outer wrapper can be wrapped into a cylinder and glued in this configuration, whereafter the cup is then inserted into the wrapper. In lieu of corrugations, the insert can be embossed with dimples, horizontal corrugations, cruciform embosses, etc. As mentioned, the insert sheet can be optionally coated with a reflective material, such as foil or metallized film, which would be positioned to reflect radiant heat back toward the inner cup. Also base sheet 12 (as well as or in lieu of insert 14) can be embossed, corrugated, or made from foamed plastic in order to provide the outside of the cup wrapper with a textured look and feel and additional insulation properties. The wrapper can also be adhered to the inner cup by one or more beads of cold glue (paste adhesive) or a thin layer of polyethylene (or similar heat sealing material) can be pre-applied to the cut side edges of the base sheet. This is then heat-activated immediately prior to wrapping the wrapper around the inner cup, and pressing the overlapping side seam to the sidewall of the inner cup to glue it in place. Since the inner cup and the insulated wrapper can be made from different material, the base sheet and/or corrugated insert can be made from recycled paper, including clay-coated recycled paper for an improved printing surface. The cup can be used to contain hot or cold solids as well as liquids.

The base sheet and the insulating insert can have different shapes. E.g., if the cup is not tapered, the opposite edges of the sheet and insert can be parallel.

Thus the scope of the invention should be determined by the appended claims and their legal equivalents, and not by the examples given.

The invention claimed is:

1. A thermally insulated cup wrapper, comprising:

an outer base sheet having a plurality of boundary edges and a corresponding plurality of edge portions adjacent said boundary edges, respectively;

an insert sheet having a plurality of edges;

at least one of said outer base sheet and said insert sheet being made of insulating material to provide an insulating layer;

said insert sheet being adhered to one side of said outer base sheet to form a thermally insulated cup wrapper;

said insert sheet being smaller in size than said outer base sheet and being positioned on said outer base sheet so that said plurality of edge portions of said outer base sheet extend beyond said edges of said insert sheet wherein said insert sheet is not attached to said outer base sheet along the plurality of edges and said edges can migrate freely;

whereby said thermally insulated cup wrapper can be wrapped around and adhered to a single wall cup to form a thermally insulated cup.

2. The thermally insulated cup wrapper of claim 1 wherein said insert sheet is made of insulating material.

3. The thermally insulated cup wrapper of claim 2 wherein said insert sheet is made of a material selected from the class consisting of corrugated material and foamed plastic.

4. The thermally insulated cup wrapper of claim 1 wherein said base sheet and said insert sheet each have a generally rectangular shape with four bounding cut edges, two of said edges being opposite side edges that are oriented at an acute angle to each other, the other two of said edges being opposite top and bottom edges that are curved and are oriented concentrically to each other.

5. The thermally insulated cup wrapper of claim 1 wherein said base sheet and said insert sheet are made of paper.

6. The thermally insulated cup wrapper of claim 1 wherein said insert sheet is coated with reflective material on at least one side of thereof.

7. The thermally insulated cup wrapper of claim 1 wherein said insert sheet is made of insulating material selected from the class consisting of corrugated material and foamed plastic, said base sheet and said insert sheet each have four bounding cut edges, two of said edges being opposite side edges that are oriented at an acute angle to each other, the other two of said edges being opposite top and bottom edges that are curved and are oriented concentrically to each other and said base sheet and said insert sheet are made of paper.

8. The thermally insulated cup wrapper of claim 1 wherein less than 20% of said insert sheet is adhered to said base sheet.

9. A thermally insulated container, comprising:

a cup having a side wall, said side wall having an inside and an outside surface;

a thermally insulated cup wrapper being wrapped around and adhered to said outside surface of said side wall of said cup;

said cup wrapper comprising a plurality of layers comprising an outer base sheet and an insert sheet;

said outer base sheet having a plurality of boundary edges and a corresponding plurality of edge portions adjacent said boundary edges, respectively;

said insert sheet having a plurality of edges;

at least one of said base sheet and said insert sheet being an insulating layer;

said insert sheet being adhered to one side of said outer base sheet;

said insert sheet being smaller in size than said outer base sheet and being positioned on said outer base sheet so that said plurality of edge portions of said outer base sheet extend beyond said edges of said insert sheet wherein said insert sheet is not attached to said outer base sheet along the plurality of edges.

10. The thermally insulated container of claim 9 wherein said insert sheet is made of said insulating material.

11. The thermally insulated container of claim 10 wherein said insulating material is selected from the class consisting of corrugated material and foamed plastic.

12. The thermally insulated container of claim 9 wherein said base sheet and said insert sheet are made of paper.

13. The thermally insulated container of claim 12, further including a coating of reflective material on at least one side of said insert sheet.

14. The thermally insulated container of claim 9 wherein said base sheet and said insert sheet each have four bounding cut edges, two of said edges being opposite side edges that are oriented at an acute angle to each other, the other two of said edges being opposite top and bottom edges that are curved and arc oriented concentrically to each other.

15. The thermally insulated container of claim 9 wherein said insert sheet is made of insulating material selected from the class consisting of corrugated material and foamed plastic, said base sheet and said insert sheet each having four bounding cut edges, two of said edges being opposite side edges that are oriented at an acute angle to each other, the other two of said edges being opposite top and bottom edges that are curved and are oriented concentrically to each other and said base sheet and said insert sheet are made of paper.

16. The thermally insulated container of claim 9 wherein said outer base sheet has a plurality of side edges that overlap and are adhered together to form an overlapping edge area, said overlapping edge area being adhered to said cup.

17. The thermally insulated container of claim 9 wherein said outer base sheet has a plurality of side edges that overlap and are adhered together to form an overlapping edge area, said insert sheet being adhered to said cup.

18. The thermally insulated container of claim 14 wherein said cup is made substantially from plastic material.

19. A container, comprising:

a cup having a side wall and a bottom; and an insulating wrapper wrapped around and adhesively attached to the side wall of the cup, the insulating wrapper comprising:

a base sheet having a top edge, a bottom edge, and side edges; and an insert sheet having a top edge, a bottom edge, and side edges located between the cup and the base sheet such that the top edge and bottom edge of the base sheet extend beyond the top edge and bottom edge of the insert sheet wherein said insert sheet is not attached to said base sheet along the top edge, the bottom edge and the side edges of the insert sheet.

20. The container of claim 19, further comprising a generally vertical strip of adhesive applied between the cup and the base sheet for adhesively attaching the insulating wrapper to the cup.

21. The container of claim 19, wherein the insert sheet is made of a different material than either the base sheet or the cup.

22. The container of claim 19 wherein less than 20% of the area of the insert sheet is adhesively attached to the base sheet.

23. The container of claim 19 wherein the side edges of the base sheet are adhered to the cup such that the side edges are adjacent to each other.

24. The container of claim 19 wherein the side edges of the base sheet define a seam.

25. The container of claim 19 wherein the insert sheet is formed from a foamed plastic.

* * * * *